US005459973A

United States Patent [19]

Baumann

[11] Patent Number: 5,459,973

[45] **Date of Patent: * Oct. 24, 1995**

[54] ENERGY DISSIPATING CONNECTOR

[76] Inventor: Hanns U. Baumann, 312 Emerald Bay, Laguna Beach, Calif. 92651

[ * ] Notice: The portion of the term of this patent subsequent to Apr. 26, 2011 has been disclaimed.

[21] Appl. No.: 231,134

[22] Filed: Apr. 22, 1994

Related U.S. Application Data

[63] Continuation of Ser. No. 893,259, Jun. 3, 1992, Pat. No. 5,305,573.

[51] Int. Cl.[6] ..... E04C 3/26

[52] U.S. Cl. ..... 52/726.1; 52/223.8; 403/43; 403/305; 411/433

[58] Field of Search ..... 52/328, 583.1, 52/726.1, 726.2, 125.2, 722, 223.13, 223.14, 223.8; 403/11, 43, 44, 305, 310, 311, 312, 334, 268, 274, 406, 300, 307, 301; 411/433, 222, 237

[56] References Cited

U.S. PATENT DOCUMENTS

| | | | |
|---|---|---|---|
| 50,190 | 9/1865 | Coupling | 403/310 |
| 1,238,994 | 9/1917 | Erickson | 403/305 |
| 1,253,149 | 1/1918 | Childers | 403/334 |
| 3,387,417 | 6/1968 | Howlett | 52/223.13 |
| 3,638,978 | 2/1972 | Guntermann | 52/726.1 |
| 3,782,061 | 1/1974 | Minutoli et al. | 52/227 |
| 3,952,468 | 4/1976 | Soum | 52/227 |
| 4,024,688 | 5/1977 | Calini | 52/726.1 |
| 4,081,219 | 3/1978 | Dykmans | 403/43 |
| 4,095,389 | 6/1978 | Outram et al. | 52/726.1 |
| 4,850,777 | 7/1989 | Lawrence et al. | 403/305 |
| 5,308,184 | 5/1994 | Bernard | 52/726.1 |

OTHER PUBLICATIONS

"No–Slip Reinforcing Steel Coupler", Promotional Material of Fox–Howlett Indusries, Inc. (1 Sheet).

"Added Damping and Stiffness Elements For Improving the Earthquake Performance of Structures", by Roger E. Scholl of CounterQuake Corp. (pp. 101–111 and 117).

"Seismic Retrofit With Energy Dissipators", by Egor P. Popov and all, NSF Project Summary of Nov. 1991 (3 Sheets).

"DYWIDAG Threadbar Reinforcing System/Posttensioning System" Promotional Material of DSI DYWIDAG Systems Int'l. (2 Sheets).

*Primary Examiner*—Carl D. Firedman
*Assistant Examiner*—Winnie S. Yip
*Attorney, Agent, or Firm*—Stetina Brunda & Buyan

[57] ABSTRACT

An energy dissipating connector for coupling first and second structural members together has a first attachment member attachable to a first rebar member of the first structural member and a second attachment member attachable to a second rebar member of the second structural member such that the second attachment member is slidably connectable to the first attachment member whereby sliding of the second attachment member relative to the first attachment member permits relative motion of the first and second structural members and dissipates energy tending to cause such motion. The second attachment member is preferably slidably moveable relative to the first attachment member by approximately ¼ inch in either direction and the second attachment member preferably moves relative to the first attachment member in response to force of at least 90,000 pounds. The first and second attachment members are preferably attachable to the first and second rebar portions via screw threads. A sleeve threadably attaches the second attachment member to the first attachment member, the second attachment member being slidably disposed within a bore formed in the sleeve.

12 Claims, 1 Drawing Sheet

Fig. 1
(PRIOR ART)
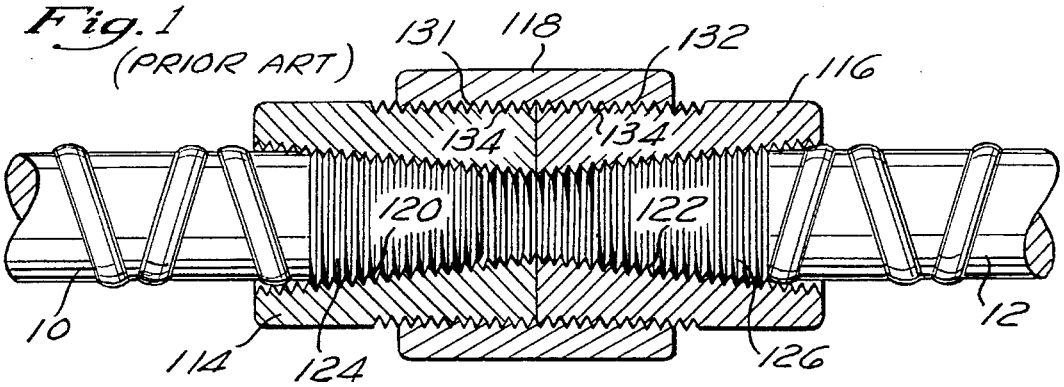
Fig. 2
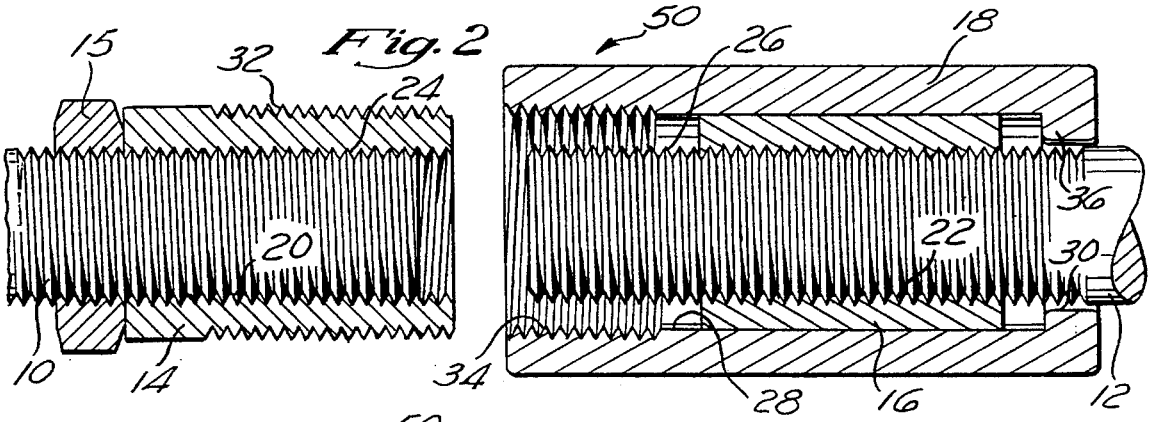
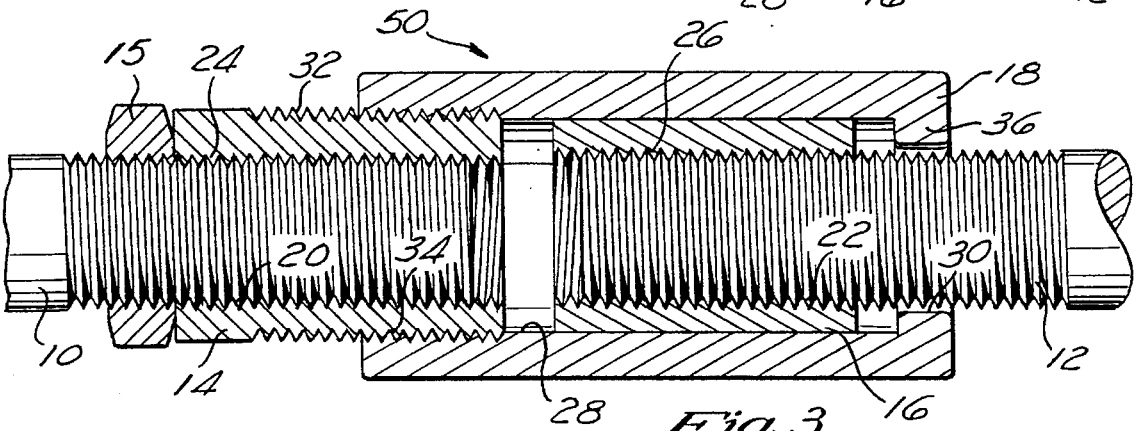
Fig. 3
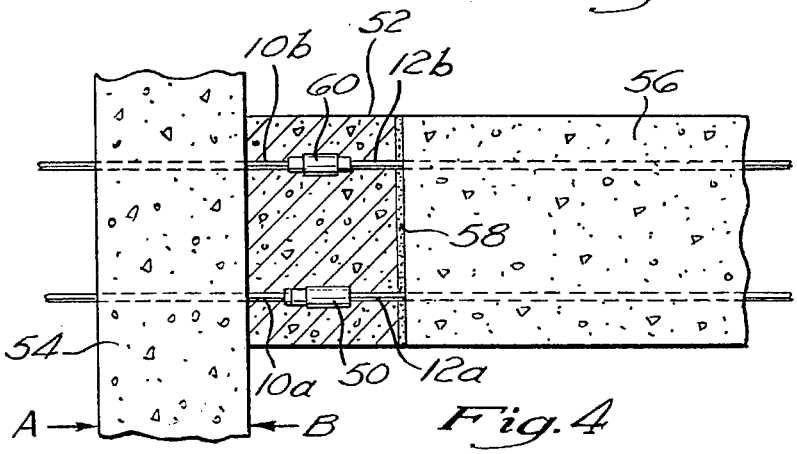
Fig. 4

ENERGY DISSIPATING CONNECTOR

This application is a continuation of application Ser. No. 07/893,259, filed Jun. 3, 1992 now U.S. Pat. No. 5,305,573.

FIELD OF THE INVENTION

The present invention relates generally to building construction, and more particularly to an energy dissipating connector for coupling structural members together. The energy dissipating connector both facilitates relative movement between adjoining structural members and dissipates energy tending to cause such movement. The energy dissipating connector is thus suited for earthquake resistant construction.

BACKGROUND OF THE INVENTION

Reinforcing steel couplers or connectors are known for attaching the abutting ends of rebar sections together. Such connectors are commonly utilized to interconnect adjoining structural members such as girders and columns in the building construction process.

For example, to attach a horizontal girder to a vertical column, the girder is positioned as desired proximate the column such that first rebar members extending from the girder are almost in abutting relationship with complimentary second rebar members extending from the column. A small gap is present at this time between the first and second rebar members. First and second coupler or attachment members are threaded onto each pair of corresponding first and second rebar members, respectively. The first and second attachment members are threaded on the inside to receive the first and second rebar members and are threaded on the outside to screw into a common or third member. Next, the third member, comprising a threaded sleeve, is positioned intermediate the first and second attachment members and then rotated such that the first and second attachment members screw thereinto, in a turnbuckle-like fashion. Thus, as the third member is rotated, the first and second attachment members, attached to the first and second rebar members, respectively, are drawn together into abutting relationship.

Such prior art connectors generally provide positive mechanical interconnection of the abutting complimentary rebar members. Such interconnection is completely rigid and does not accommodate relative longitudinal motion of the rebar members. Consequently, relative motion of the joined structural members, i.e., girders and/or columns, is likewise not facilitated.

As such, although contemporary reinforcing steel couplers or connectors are generally suitable for their intended purposes, they possess inherent deficiencies which detract from their overall effectiveness in building construction. It is therefore desirable to provide an alternative reinforcing steel coupler or connection which accommodates a degree of longitudinal motion of the abutting rebar members and consequently likewise accommodates a degree of relative movement of the joined structural members, i.e., columns and/or girders.

SUMMARY OF THE INVENTION

The present invention specifically addresses and alleviates the above mentioned deficiencies associated in the prior art. More particularly, the present invention comprises an energy dissipating connector for coupling first and second structural members together. The energy dissipating connector has a first attachment member attachable to a first rebar member extending from the first structural member and a second attachment member attachable to a second rebar member extending from the second structural member such that the second attachment member is slidably connectable to the first attachment member whereby sliding of the second attachment member relative to the first attachment member permits relative motion of the first and second structural members and dissipates energy tending to cause such motion.

The second attachment member is preferably slidably moveable relative to the first attachment member by approximately ½ inch, i.e., ¼ inch in either direction, and the second attachment member preferably moves relative to the first attachment member in response to a force of at least 90,000 pounds. The first and second attachment members are preferably attachable to the first and second rebar portions via screw threads, preferably tapered or pipe threads. A sleeve threadably attaches the second attachment member to the first attachment member, the second attachment member being slidably disposed within a bore formed in the sleeve.

These, as well as other advantages of the present invention will be more apparent from the following description and drawings. It is understood that changes in the specific structure shown and described may be made within the scope of the claims without departing from the spirit of the invention.

BRIEF DESCRIPTION OF THE DRAWINGS

FIG. 1 is a cross-sectional side view of a prior art coupling or connector;

FIG. 2 is a cross-sectional side view of the energy dissipating connector of the present invention wherein the first attachment member is detached from the sleeve.

FIG. 3 is a cross-sectional side view of the energy dissipating connector of the present invention wherein the first attachment member is attached to the sleeve; and FIG. 4 is a cross-sectional side view of adjoining structural members, i.e., a column and girder, interconnected utilizing energy dissipating connectors according to the present invention.

DETAILED DESCRIPTION OF THE PREFERRED EMBODIMENT

The detailed description set forth below in connection with the appended drawings is intended as a description of the presently preferred embodiment of the invention, and is not intended to represent the only form in which the present invention may be utilized or constructed. The description sets forth the functions and sequence of steps for constructing and operating the invention in connection with the illustrated embodiment. It is to be understood, however, that the same or equivalent functions and sequences may be accomplished by different embodiments that are also intended to be encompassed within the spirit and scope of the invention.

The energy dissipating connector of the present invention is illustrated in FIGS. 2 through 4 of the drawings which depict a presently preferred embodiment of the invention. FIG. 1 depicts a prior art rigid reinforcing steel coupler or connector.

Referring now to FIG. 1, the prior art coupling comprises a first attachment member 114 having tapered or pipe threads 120 formed inside thereof and which is threadable onto a rebar member 10 to effect attachment thereto. In a like fashion, second attachment member 116 has tapered or pipe threads 122 formed inside thereof and is likewise attached to second rebar member 12. Sleeve 118 has threads 134 formed on the inside thereof which mate with corresponding threads 131 on the first attachment member 114 and corresponding threads 132 on the second attachment member 116.

The prior art device is utilized by threading the first connector 114 onto the first rebar member 10 and similarly threading the second attachment member 116 onto the second rebar member 12. Next, the sleeve 118 is positioned intermediate to the first 114 and second 116 attachment members which are then introduced thereinto. Rotating the sleeve 118 causes the first 114 and second 116 attachment members to be drawn or threaded thereinto in a turnbuckle-like fashion. The sleeve 118 is rotated until the first 114 and second 116 attachment members are in abutting relationship, thus rigidly interconnecting the first 10 and second 12 rebar members.

As can be readily appreciated, the prior art interconnection of the first 10 and second 12 rebar members is rigid, and as such facilitates no relative axial or longitudinal movement of the first 10 and second 12 rebar members and the associated structural members from which they extend. Thus, any movement of the structural member from which the first rebar member 10 extends is transmitted, essentially undiminished, to the second structural member, from which the second rebar member 12 extends. Essentially none of the energy transmitted from the first structural member to the second structural member is dissipated by the prior art connector.

Referring now to FIGS. 2 and 3, the present invention generally comprises a first attachment member 14 having threads 20, preferably tapered or pipe threads, for engaging a complimentary threads 24 formed upon a rebar portion 10. Threads 32 formed about the outer surface of the first attachment member attach to corresponding threads 34 of sleeve 18. Sleeve 18 comprises a bore 28 into which second attachment member 16 is captured and slidably disposed.

Detent 36, preferably formed as an annular area of reduced diameter, captures second attachment member 16 within the bore 28 of the sleeve 18 and thus prevent it from being pulled therefrom through opening 30 in the distal end of sleeve 18. Opening 30 is sized to slidably receive the second rebar member 12 and has a diameter substantially less than that of second attachment member 16 as such that second attachment member 16 can not pass therethrough. As in the first attachment member 14, threads 22, preferably tapered or pipe threads, of the second attachment member 16 attach to corresponding threads 26 of rebar portion 12. Optional lock nut 15 secures first attachment member 14 in place upon the first rebar member 10 by being jammed or tightened securely into abutment therewith.

The first 14 and second 16 attachment members may optionally be comprised of hardened steel such that they may function as self-taping members for rebar portions 10 and 12 to eliminate the requirement for threading the ends of the rebar portions 10 and 12 prior to engagement with the first 14 and second 16 attachment members. Alternatively, the first 14 and second 16 attachment members may be comprised of a softer material and/or the first 10 and second 12 rebar portions tapped prior to engagement therewith.

The first 10 and second 12 rebar members are preferably schedule 11 and the second attachment member 16 is press fitted into the bore 28 of the sleeve 18, preferably such that a force of at least approximately 90,000 pounds is required to effect movement of the second attachment member 16 within the bore 28 of the sleeve 18. Those skilled in the art will recognize that the force may be less than 90,000 pounds for smaller rebar sizes and greater than 90,000 pounds for larger rebar sizes. For example, a force of 300,000 pounds is preferred for schedule 18 rebar.

The second attachment member 16 is preferably disposed within the bore 28 of the sleeve 18 such that approximately ¼ inch of travel is possible in either direction. This provides a total travel of approximately ½ inch. Thus, upon experiencing a longitudinal force of at least 90,000 pounds, the second attachment member 16 may move up to ¼ of one inch in the direction of the applied force. Those skilled in the art will recognize that the amount of travel desired depends upon the joint geometry. For example, tall bridge piers may require a travel of 1 inch in either direction.

Having described the structure of the energy dissipating connector of the present invention, it may be beneficial to describe the operation thereof. To install the energy dissipating connector, two structural members, e.g., girders and/or columns, are placed in close proximity such that corresponding rebar members thereof extend toward each other and almost abut. Of course, the first 14 and second 16 attachment members, including sleeve 18 are threaded onto the first 10 and second 12 rebar portions while they are sufficiently separated to do so.

With particular reference to FIG. 2, the lock nut 15 is first threaded onto the first rebar member 10 and then the first attachment member 14 is threaded thereon. The first attachment member 14 is preferably positioned upon the first rebar member 10 such that the distal end of the first rebar member 10 is approximately flush with the distal end of the first attachment member 14 and does not extend therefrom.

Next, the second attachment member 16, disposed within the bore 28 of the sleeve 18, is threaded onto the second rebar member 12, preferably such that the distal end of the second rebar member 12 will be approximately flush with and not extend beyond the distal end of the second attachment member 16 when assembly is complete (as depicted in FIG. 3). This is to assure that the assembled energy dissipating connector facilitates full travel, i.e., ¼ inch in either direction, of the second attachment member 16 within the bore 28 of the slide 18.

After the first 14 and second 16 attachment members have been threaded onto the first 10 and second 12 rebar members, respectively, then the sleeve 18 is threaded onto the first attachment member 14. The threads 34 of the sleeve 18 are formed such that the first attachment member 14 screws only sufficiently far into the bore 28 of the sleeve 18 to permit ¼ inch of travel of the second attachment member 16 within the bore 28 of the sleeve 18 when the first attachment member 14 is screwed fully thereinto. That is, the distal end of the first attachment member 14 is disposed approximately ¼ inch from the distal end of the second attachment member 16 when the energy dissipating coupling of the present invention is fully assembled.

If hardened steel self tapping first 14 and second 16 attachment members are utilized, then the rebar portions 10 and 12 need not be tapped prior to installation of the energy dissipating connector. The first attachment member 14 could be threaded onto the first rebar member 10 to form threads thereon, then temporarily removed so that the lock nut 15 can be added.

Use of the energy dissipating connectors of the present invention is illustrated in FIG. 4 of the drawings wherein an energy dissipating connector 50 is utilized to interconnect first 10A and second 12A lower rebar members. A contemporary reinforcing steel coupler or connector 60 is similarly utilized to effect interconnection of first 10B and second 12B rebar members disposed superior to the first 10A and second 12A rebar members. A fiber reinforced concrete spacer 52 is formed intermediate the first structural member or column 54 and the second structural member or girder 56. A joint or layer of compressible material 58, i.e., rubber or felt, is disposed intermediate the concrete spacer 52 and the second structural member or girder 56 to facilitate relative movement of the first 54 and second 56 structural members during actuation of the energy dissipating connector of the present invention. The joint or layer of compressible material 58 is installed next to where the rebar member 12A must be able to move left or right. The compressible material is preferably approximately ⅝ of an inch thick.

Since external forces, i.e., wind sheer and earthquake, cause motion of the building's structural members which result in rotations of the first 54 and second 56 structural members relative to each other about the intersection thereof, the joint formed by the contemporary coupler 60 and the energy dissipating connector 50 of the present invention is configured to facilitate such relative motion or rotation. Thus, in the application of the energy dissipating connector 50 of the present invention, the contemporary coupler 60 functions as a pivot to allow rotational or angular movement of the first 54 and second 56 structural members thereabout while the energy dissipating connector 50 of the present invention acts as a dampening device which tends to limit such movement and dissipate the energy effecting such movement.

More particularly, if a force such as that due to an earthquake were applied in direction A to vertical first member 54, inertia would tend to cause the second structural member 56 to remain in place, thus causing the first structural member 54 to rotate about the contemporary coupler 60 in direction A. If the force applied to the energy dissipating connector 50 of the present invention exceeds 90,000 pounds, then the second attachment member 16 would slide within the bore 28 of the sleeve 18 toward the first attachment member 14 by up to ¼ of an inch and the lower portion of the compressible material 58 would be compressed.

As a further example, a force applied in the opposite direction would tend to cause the first structural member 54 to rotate about the contemporary coupling 60 in direction B such that tension is applied to the energy dissipating connector 50 such that the first attachment member 14 is urged away from the second attachment member 16. If the force applied thereto is greater than 90,000 pounds, then the first attachment member 14 moves away from the second attachment member 16 and the compressible material 58 at the bottom is permitted to expand.

As such, it can be appreciated that the energy dissipating connector of the present invention facilitates a degree of relative motion of the first 54 and second 56 structural members in a manner in which prevents damage thereto during an earthquake. Additionally, the frictional sliding of the second attachment member 16 within the bore 28 of the sleeve 18 tends to dissipate the energy of the force applied to the energy dissipating connector 50. The energy is dissipated in form of heat as the second attachment member 16 slides through the bore 28 of the sleeve 18. As such, the energy dissipating connector of the present invention substantially reduces the potential for structural damage, i.e., failure of a structural member, as a result of experiencing forces such as those incurred during earthquakes.

The energy dissipating connector of the present invention thus allows the tuning of tall buildings and/or bridge structures such that the amount of lateral earthquake force that is required to resist is minimized. That is, by constructing the structures such that lateral earthquake forces are dissipated thereby, they need not be built as strongly as would otherwise be required. For example, if a building is required to resist an earthquake having a Richter scale rating of 6, then that building may be constructed to resist an earthquake of a lower rating, e.g., a Richter rating of 5, and still be able to resist the more powerful earthquake when utilizing the energy dissipating connector of the present invention.

The present invention will find application in tall poured-in-place structures and will additionally be beneficial in the use of precast concrete. Precast concrete has previously not been used in tall structures located in seismic regions. However, by minimizing the lateral forces which such structures are required to resist, the same size members can be utilized in much taller buildings. Thus, such tall buildings can be constructed in regions of high seismic activity such as Hong Kong, Tokyo, Los Angeles, San Francisco, Mexico City, Manila, Caracas, Santiago, Bogota, and Cairo, for example. The energy dissipating connector of the present invention will allow such structures to absorb and dissipate the force of earthquakes, resulting in very little damage thereto.

It is understood that the exemplary energy dissipating connector of the present invention described herein and shown in the drawings represents only a presently preferred embodiment of the invention. Various modifications and additions may be made to such embodiment without departing from the spirit scope of the invention. For example, various means other than threads may be utilized for interconnecting the first and second attachment members to the first and second rebar members, respectively, and for attaching the first attachment member to the sleeve 18. Additionally, various materials other than steel may be utilized in the fabrication of the energy dissipating connector of the present invention. Furthermore, the bore and outer circumference of second attachment member need not be cylindrical as illustrated and described, but rather may be of any generally complimentary configuration, i.e., triangular, oval, square, hexagonal, star shaped and splined. Thus, these and other modifications may be obvious to those skilled in the art and may be implemented to adapt to the present invention for use in a variety of different applications.

What is claimed is:

1. A joint for coupling first and second structural members together, said joint comprising;

at least one rigid connector attaching corresponding rebar portions of the first and second structural members together;

at least one energy dissipating connector disposed proximate said rigid connector, attaching corresponding rebar portions of the first and second structural members together, said energy dissipating connector comprising:

a first attachment member attached to a first rebar portion of the first structural member;

a second attachment member attached to a second rebar portion of the second structural member, said second attachment member slidably connectable to said first attachment member; and wherein said energy dissipating connector facilitates rotation of said first structural member relative to said second structural member and dissipates energy tending to cause such rotation.

2. The joint as recited in claim 1 further comprising a fiber reinforced concrete spacer disposed about said rigid connector and said energy dissipating connector, intermediate said first and second structural members.

3. The joint as recited in claim 2 further comprising a compressible material disposed intermediate said concrete spacer and said second structural member for facilitating relative motion therebetween.

4. The joint as recited in claim 3 wherein:

said second attachment member is slidably moveable relative to said first attachment member by approximately ¼ inch in either direction; and said compressible material is approximately ⅝ inch thick.

5. The joint as recited in claim 1 wherein said second attachment member moves relative to said first attachment member in response to a force of at least 90,000 pounds.

6. The joint as recited in claim 1 wherein said energy dissipating connector is disposed inferior to said rigid connector.

7. A joint for coupling first and second structural members together, said joint comprising:

at least one rigid connector attaching corresponding rebar portions of the first and second structural members together;

at least one energy dissipating connector disposed inferior to said rigid connector, attaching corresponding rebar portions of the first and second structural members together; said energy dissipating connector comprising:

a first attachment member threadably attached to a first rebar portion of the first structural member;

a sleeve threadably attached to said first attachment member, said sleeve having a bore;

a second attachment member threadably attached to a second rebar portion of the second structural member, said second attachment member slidably captured within the bore of said sleeve; and wherein said energy dissipating connector facilitates rotation of said first structural member relative to said second structural member and dissipates energy tending to cause such rotation.

8. The joint as recited in claim 1 further comprising a fiber reinforced concrete spacer disposed about said rigid connector and said energy dissipating connector, intermediate said first and second structural members.

9. The joint as recited in claim 8 further comprising a compressible material disposed intermediate said concrete spacer and said second structural member for facilitating relative motion therebetween.

10. The joint as recited in claim 9 wherein:

said second attachment member is slidably moveable relative to said first attachment member by approximately ¼ inch in either direction; and said compressible material is approximately ⅝ inch thick.

11. The joint as recited in claim 1 wherein said second attachment member moves relative to said first attachment member in response to a force of at least 90,000 pounds.

12. The joint recited in claim 1 wherein said energy dissipating connector further comprises a lock nut threaded upon said first rebar member, and disposed in abutting relation to said first attachment member to secure said first attachment member in place.

* * * * *